US005131175A

United States Patent [19]

Liu

[11] Patent Number: 5,131,175

[45] Date of Patent: Jul. 21, 1992

[54] WATER SPRAYING DEVICE FOR CRYSTAL BALL

[76] Inventor: J. H. Liu, No. 3, Alley 202, Kao-Fong Rd., Hsin-Chu City, Taiwan

[21] Appl. No.: 571,455

[22] Filed: Aug. 23, 1990

[51] Int. Cl.[5] ..... G09F 19/00

[52] U.S. Cl. ..... 40/410; 40/406

[58] Field of Search ..... 40/410, 406, 409; 239/23, 20, 17; 415/206

[56] References Cited

U.S. PATENT DOCUMENTS

| | | | |
|---|---|---|---|
| 1,954,704 | 4/1934 | Kraus | 415/206 X |
| 4,641,945 | 2/1987 | Rossi | 40/410 |
| 4,817,311 | 4/1989 | Ong S.T. | 40/406 X |
| 4,961,276 | 10/1990 | Lin | 40/410 |

*Primary Examiner*—Kenneth J. Dorner
*Assistant Examiner*—J. Bonifanti
*Attorney, Agent, or Firm*—Larson and Taylor

[57] ABSTRACT

A water spraying device for a crystal ball containing a decorative item, essentially comprising a pump housing having a water inlet and outlet and fixed at both sides to a rubber plug seat which is mounted below the base for the decorative items within the crystal ball. The device also includes a pump impeller driven by a small type of motor within said pump housing to pump the water entering from the inlet to the outlet for spraying out, thus making the snow within the crystal ball to fluff and tumble and to form a very attractive sight. The pump impeller and pump housing are configured such that it does not require the motor to be mounted before filing the crystal ball with clean water.

12 Claims, 6 Drawing Sheets

WATER SPRAYING DEVICE FOR CRYSTAL BALL

FIELD OF THE INVENTION

The present invention relates to crystal balls that contain a decorative item, and in particular relates to a water spraying or pumping device for crystal balls that contain "snow flakes".

BACKGROUND OF THE INVENTION

Whereas, the general practice of a crystal ball creates a dynamic landscape, particularly those balls using a motor or a music bell as the main drive to pump the clean water within the crystal ball so that the snow flakes within will maintain continuous fluffing and tumbling. Crystal balls having such effects have been very popular, but still there are certain difficulties that arise during the assembling operation or which relate to practicability and need resolution. These are described as follows.

1) There is no way in the prior art to remove the motor alone either for maintenance or for replacement in the event of failure of motor. Any forced removal of the motor will cause the clean water to overflow or create an air bubble within the crystal ball to affect the product quality due to the failure to control the liquid seal against the seepage of clean water from within the crystal ball or of the air from the outside.

2) In the prior art, the motor is required to be incorporated with the fans or impeller blades in the pump port during the operation of removing the air bubble when filling clean water into the crystal ball. Otherwise, the interior of the crystal ball is vulnerable to the return of air when the motor is mounted afterwards. In order to completely dispel the air within the crystal ball, the existing practice involves dipping the whole unit into the water before applying the air vacuum method, thus constituting a comparatively ideal way. The prior art requires the motor to be mounted afterwards leading to the air will easily return to the pump port to form air bubbles. Furthermore, the assembly already mounted with motor does not eliminate the aforesaid defects of the prior art.

SUMMARY OF THE PRESENT INVENTION

The present invention provides a configuration of water spray device with the chief object to completely dispel the air bubble during the filling of clean water into the crystal ball. As a result of the present invention, it is not required to assemble the motor with the impeller or the fan in the pump port at that same time, and it can be incorporated after the completion of said filing operation. The air is prevented from flowing past the liquid back to the pump port for adapting to the operating method by vacuuming, thus ensuring a quality product of crystal ball.

Another object of the present invention is to allow the easy replacement of the motor by the end user in the event of motor failure after a certain period or excessive noise from the motor. This prevents the rejection of the entire crystal ball.

BRIEF DESCRIPTION OF THE DRAWINGS

The present invention will become more readily apparent from the following description of the preferred embodiments of the present invention taken in conjunction with the accompanying drawings, in which.

DESCRIPTION OF THE PREFERRED EMBODIMENTS

Figure 1:
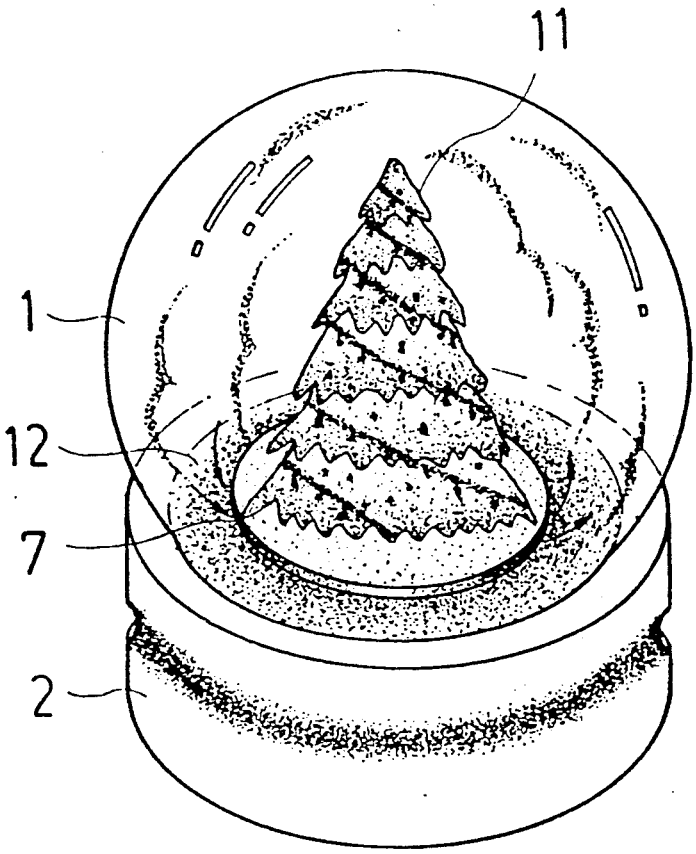
FIG. 1 is a perspective view of the appearance of the present invention.
Figure 2:
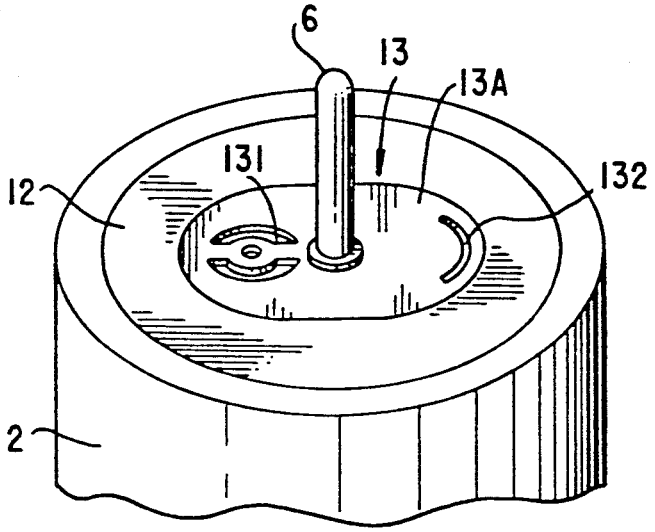
FIG. 2 is a perspective view illustrating the respective position of the pump and the rubber seat of the present invention.
Figure 3:
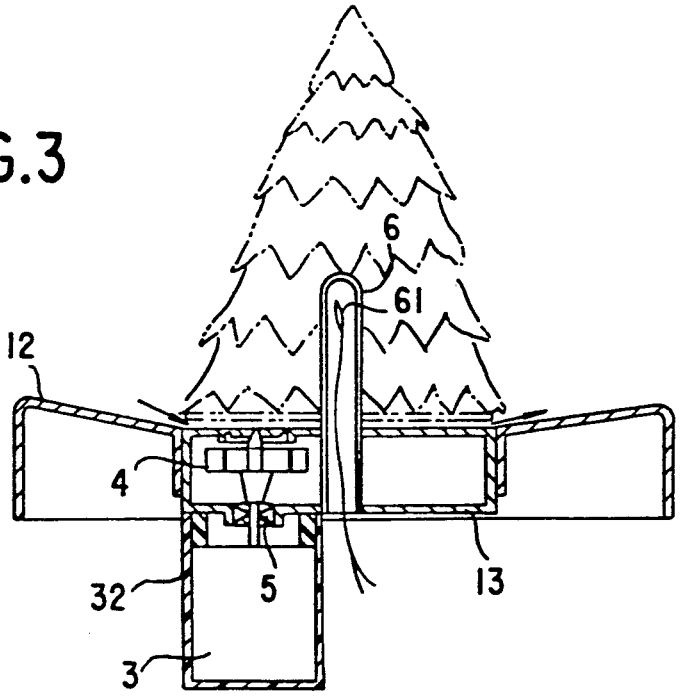
FIG. 3 is the sectional view of the present invention.
Figure 5:
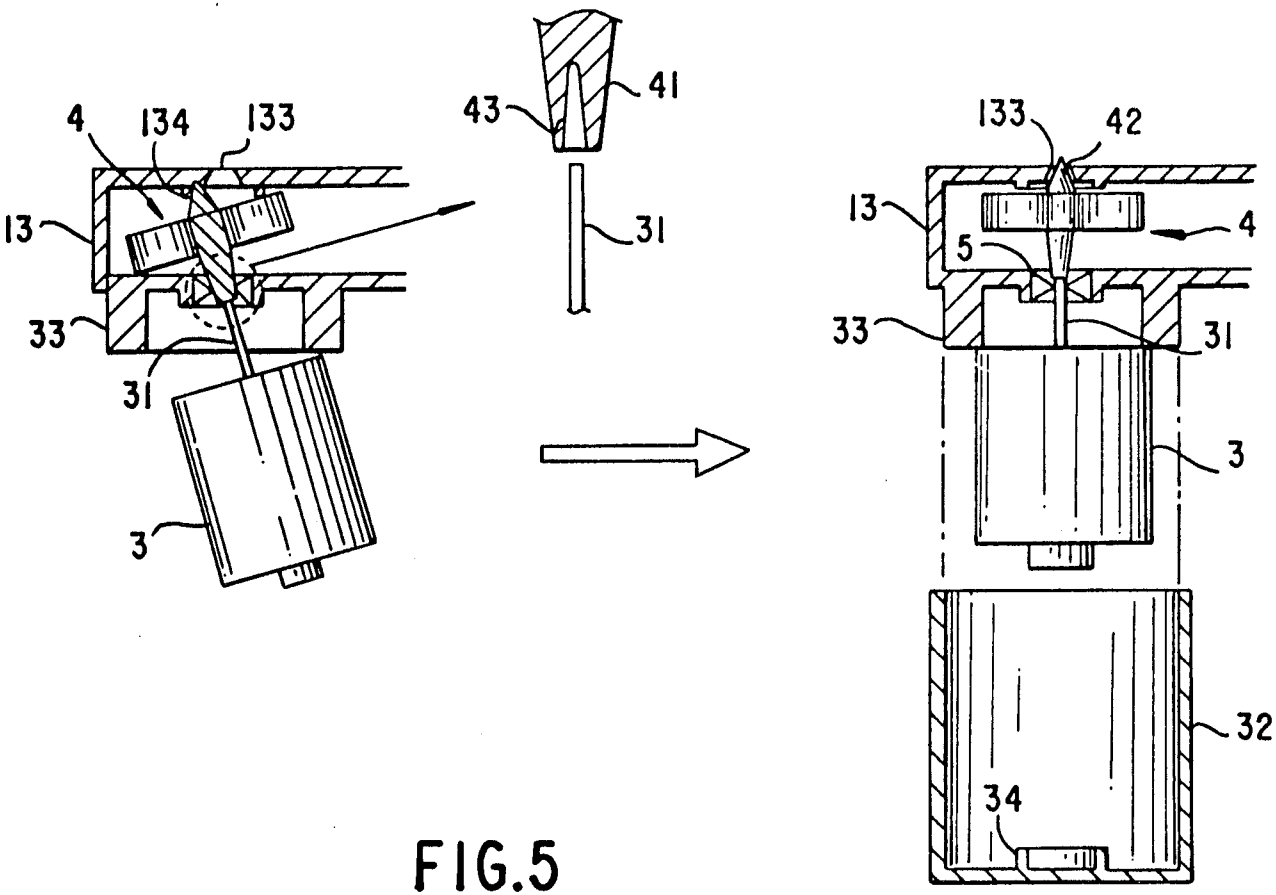
FIG. 5 is a flow chart of the mounting of the fans and motor of the present invention.

Referring now to FIGS. 1, 3 and 5, of the accompanied drawings, there is illustrated a pump housing 13, herein sometimes just called a pump, that is fixed at the center of a rubber plug seat 12 below a base 7 of a decoration item 11 within the crystal ball 1 and mounted on a base support or lower housing 2 of the present invention. At both sides of an upper lid 13A of pump 13 there are a water inlet 131 and a water outlet 132 for circulating water for spraying. Inside ball 1 are snow flakes (not shown) which tumble along with the water jet, thereby providing a very attractive view of decoration item 11 inside crystal ball 1.

Figures 4, 4A:
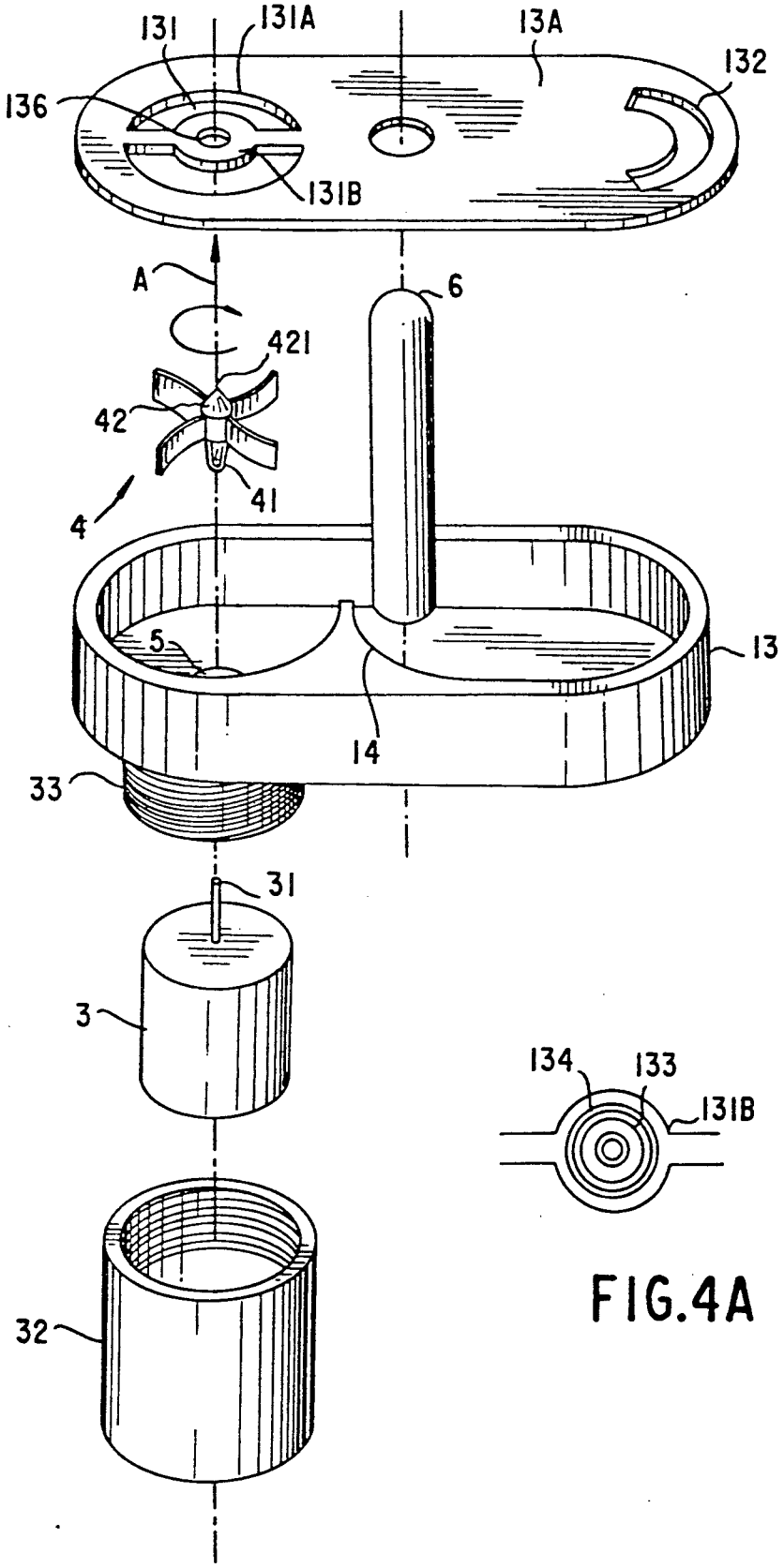
FIG. 4 is an exploded view of the motor and the pump housing configuration of the present invention.
FIG. 4A is a bottom plan view taken at arrow A in FIG. 4.

FIGS. 3 and 4 illustrate pump housing 13 as having a rectangular solid shape and having a rounded shape at its both sides to form an oval or racetrack shape in plan view. Pump housing 13 has a guide vane 14 to either side, and an upper lid 13A is disposed above thereby forming a space within the pump housing 13. In the center of an opening 131A to one side of said upper lid 13A is mounted an overhead fan supporting rack 131B for forming a natural passage between the circle of the opening 131A and the fan supporting rack 131B to serve as water inlet 131. To the other side of said upper lid 13A, an opening having a crescent shape serves as the water outlet 132. In addition, within said pump housing 13 at the lower part, corresponding to said opening 131A, there is mounted a pump impeller or fan 4 having a plurality of blades or fans and which rotates clockwise as driven by a small motor 3. By means of the high rpm rotation of impeller 4, water directed from inlet 131 is pumped to eject out of the outlet 132 at the other end.

With reference now to FIGS. 3, 4 and 5, there is illustrated the configuration of impeller 4 and small motor 3, there disposed in a round opening 136 at the center of fan supporting rack 131B in the middle of upper lid 13A of pump housing 13. Also illustrated is a collar chute 133 located at the base of said supporting rack 131B and a boss or protruding ring 134 depending from the bottom surface of upper lid 13A located at the flange of said chute 133, chute 133 having a proper radius using said opening 136 as the circumference. Furthermore, a conical member 42 having a proper height at the upper end of a fan shaft, axle or axis 41 extends above the fans 4 within pump housing 13 while the diameter of the lower end of fan axle 41 has an inward convergence and is provided with a bore 43 for receiving the motor shaft, axis or axle 31 of motor 3.

Bore 43 has an outerward spreading in this slanting direction inverse to fan axle 41.

By way of the aforesaid configuration, the whole set of fans 4 is shown at an inclined or slanting angle and fixed between the upper lid 13A and liquid seal 5 (since said liquid seal 5 is made of resilient material, the inward converging shaped fan axle 41 can be inserted into liquid seal 5 and yawed to a certain oblique angle). Once impeller 4 is placed into pump housing 13 and fixed to the upper lid 13A, the fan axle 41 of impeller 4 is inserted into and protrudes out of the liquid seal 5 of the motor. Also the tip 421 of the conical member 42 at the upper end of fan axle 41 is snapped in the chute 133 at the base of said supporting rack 131B.

In the present invention, after the assembling of fans 4 to pump 13, pump 13 to rubber plug seat 12 and rubber plug seat 12 to the crystal ball 1, the whole assembly is dipped into the water for dispelling all air bubbles in this assembly. Generally in the operation of the prior art, air can possibly enter the ball from the liquid seal after the completion of the air evacuation operation; while in the present invention, after the vacuuming, said liquid seal 5 is already segregated by the plugging of fan axle 41, thus preventing re-entering of air.

Upon completing the evacuation operation in the present invention, the final process of assembling of motor 3 is illustrated in FIG. 5. Motor 3 is placed at the same oblique position with the fan axle 41 and axle 31 is engaged with axial bore 43. The push from the insertion of the axle 31 into the axial bore 43 is limited by the chute 133 and the protruding ring 134 of the fans supporting rack 131B. Thus the fan axle 41 will not be moved due to such push. Once axle 31 is retained in axial bore 43, the motor 3 is pulled backwards, thereby disengaging conical member 42 of impeller 4 from being limited by the chute 133 while motor 3 is positioned into its proper axial alignment. Then motor 3 is pushed further onward making the fan axle 41 to be removed from liquid seal 5. At this time, liquid seal 5 is snapped onto the smooth axle 31 of the motor 3. The conical member 42 of the said fan axis 41 will then seat into the opening 132 at the center of said fans supporting rack 131B; thus the fixed position for the fans 4 can be generally assured.

Furthermore, upon the completion of the aforesaid assembling, motor 3 is placed into a casing 32, which is then bolted to a retaining or fixing tube 33 below the pump 13 and fans 4; since motor 3 is limited between retaining tube 33 and the positioning groove 34 at the bottom inside the casing, motor 3 will secure a proper mounting position to activate fans 4 to rotate. Similarly, in the event of replacing motor 3, one simply needs to reverse the mounting procedure.

The said pump 13 is mounted at the center of the rubber plug seat 12 and enables the water inlet 131 and the outlet 132 to function at its both sides; the said rubber plug seat 12 is fabricated in the form slanting towards the pump 13 at the center from the circumference (as illustrated in FIG. 3) so that the snow flakes within the crystal ball 1 will not get accumulated at a dead angle where the water jet cannot reach, thereby avoiding the possibility of spoiling the flying effect of the snow flakes.

In addition, a transparent PVC pipe 6 with one end sealed has been inserted at the center of pump housing 13 of the present invention, said PVC pipe 6 entering deeply into the said decorating item 11. Within said PVC pipe 6 a lamp 61 is installed to emphasize the decorating effect of the decorating item 11 (as illustrated in FIG. 3).

Based on the aforesaid preferred embodiment of the present invention by using the design of water inlet 131, water outlet 132 of pump 13 and the fans 4, the snow flakes within the crystal ball 1 will continue to tumble along with the water jet. Provided that, however, according to the material operation, the said water jet is having a regular circulation, i.e, the fluffing of the said snow flakes is rather regular and actually adding no help to beautify the view within the crystal ball, and there still exists the dead angle partial water jet fails to stir the snow flakes and where may result in the accumulation of snow flakes, creating very inconsistent in the view; therefore, these can be improved in the configuration of the second embodiment of the present invention.

Figure 6:
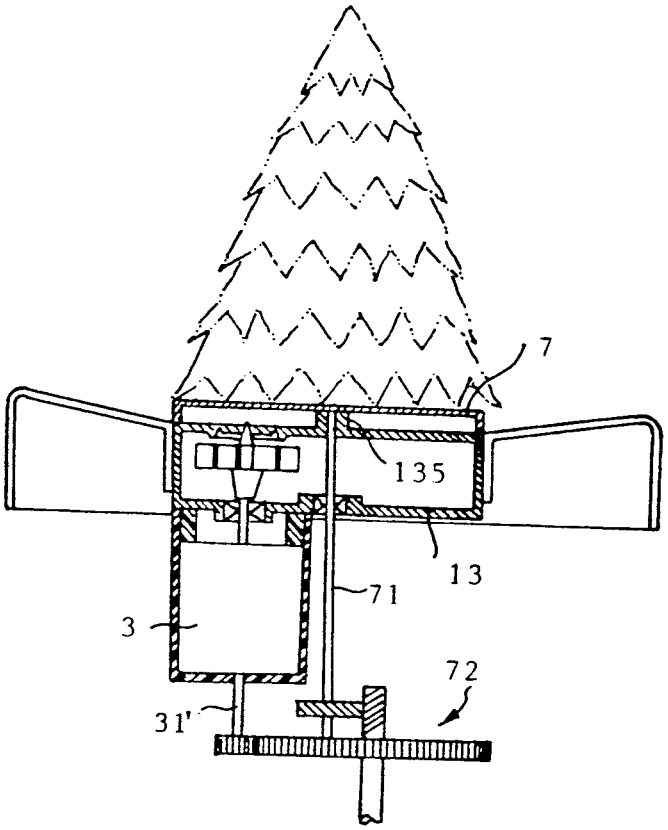
FIG. 6 is a cross-sectional view of a second embodiment of the present invention.

FIG. 6 illustrates the second preferred embodiment wherein axle 31 of motor 3 which rotates fan 4 also has a portion or protrusion 31' that extends at the lower end of the motor 3. Therefore, once motor casing 32 is bolted to the fixing tube 33, axle 31' at the lower end of said motor is also protruding from the lower end of the casing 32.

Furthermore, base 7, which retains decorating item 11, has disposed at the center of its bottom and mounted thereto a driving shaft or rotatable axle 71 which penetrates said pump housing 13 and extends to the proper distance. Then by means of the geared transmission obtained by the gearing unit 72 (not given detailed description here due to such being a generally practiced mechanism) disposed between the lower end of said rotation axis or axle 71 and the said motor axle 31', the said base 7 will rotate along at the same time as when the water is pumped by rotating impeller when power is applied to motor 3.

Figure 7:
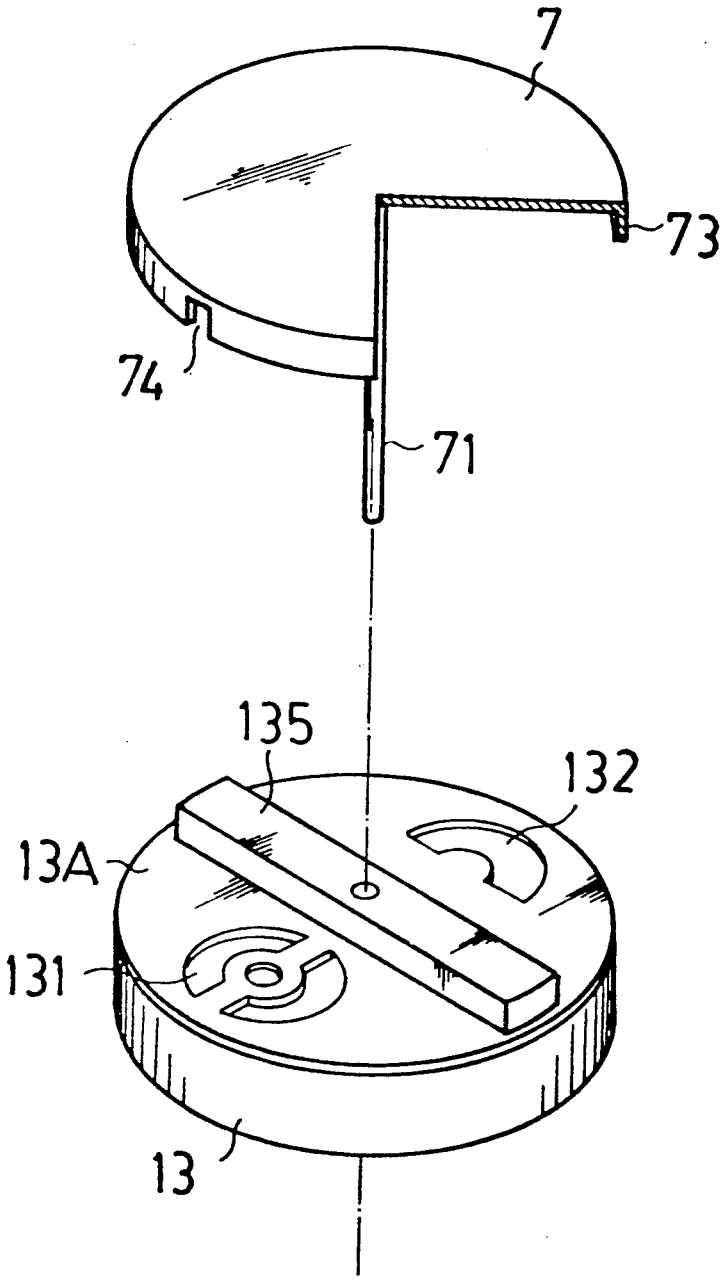
FIG. 7 is an exploded view of the seat and the upper lid of part of the pump housing of the second embodiment of the present invention.

FIG. 7 illustrates the means to eliminate the dead angle by using the space between the base 7 and the upper lid 13A of the pump 3 to control the water jet. Within a collar flange 73, which is a flange means located at the peripheral of the bottom of the base 7, are provided several openings or dents 74 equiangularly distributed around flange 73. Pump portion 13 below the base 7 can be made having the same outer diameter as that of the base 7. There is also depicted a separating bar 135 or separating means for separating the liquid flow through openings 131 and 132. Separating bar 135 the same inner diameter with that of the said base 7 and extends above the upper surface of the upper lid 13A between water inlet 131 and water outlet 132 of the upper lid 13A of pump housing 13. The height of separating bar 135 equals that of the flange 73 of said base 7. Thus once the said base 7 is snapped above the pump portion 13, the base can be supported by said separating bars 135 and the space encompassed by the flange 73 of the base 7 and the upper lid 13A is divided into two major spaces.

By means of the aforesaid configuration, at the same time when the base 7 is gear driven by the motor 3, the water jet pumped by the water outlet 132 of the pump portion 13 will be ejected out of the dents 74 at the said base 7. Furthermore, within flange 73 of the circumference of said base 7, both the water incoming and water outgoing through dents 74 are in a rotating state on the base 7. Therefore, the dead angle or space for stirring the snow flakes can be eliminated, and the water current ejected from the dents 74 within the water outgoing area of base 7 rotates, making said water turbulent so to enable the fluffing of the snow flakes and thereby creating a very natural and active presentation.

To sum up, the present invention uses the configuration of pump portion, base and fans, the decorating snow flakes within the crystal ball will float and tumble along with the ejected water current; and by the mounting of the fans and their supporting rack, there is no need for prior installation of the motor until after the completion of the air evacuation during the filling of clean water into the crystal ball. This then avoids the possibility of water entering the motor during the assembling operation. Further, because of the aforesaid configuration, in the event of a short circuit or failure of motor 3, the motor can be easily replaced by the owner, thus preventing a discarding of the entire crystal ball.

What is claimed is:

1. A device for spraying a liquid, such as water, contained in a crystal ball ornament that also includes a base support, a crystal ball mounted on the base support, and a decoration item mounted inside the crystal ball, the spraying device comprising:

a base which supports the decoration item inside the crystal ball;

a pump housing having an interior cavity and mounted spaced below the underside of said base, said pump housing including an upper lid that seals the cavity and has spaced apart liquid inlet and liquid outlet openings therethrough, separating means extending above the upper surface of said upper lid between said inlet and outlet openings for separating the liquid flow through said openings, an orifice in the bottom of said housing, and a resilient liquid seal mounted in said orifice;

a flange means located around at least one of said base and said upper lid and extending in the space therebetween, said flange means having a plurality of openings therethrough;

an impeller mounted in said pump housing interior cavity; and means for rotating said impeller and at least said flange means.

2. A device as claimed in claim 1 wherein said pump housing upper lid includes a means for mounting said impeller, and a boss depending from the bottom surface thereof; and wherein said impeller comprises an axle and a plurality of blades mounted on said impeller axle, said impeller axle comprises a conical upper member and has an axial length such that during assembly of said device, said conical upper member can be positioned against said boss, and the lower end of said impeller axle will extend through and will be sealed by said liquid seal.

3. A device as claimed in claim 2 wherein said impeller mounting means comprises a collar chute having a central opening and said conical upper chamber of said impeller axle is configured so as to be able to be received by said collar chute; and wherein said depending boss has a length and said collar chute has a depth such that said conical upper member of said impeller axle can be mounted in said collar chute with the lower end of said impeller axle extending above said liquid seal.

4. A device as claimed in claim 1 wherein said impeller and flange rotating means includes a motor, a motor shaft driven by said motor and a set of gears which operatively connect said motor shaft to said flange means.

5. A device as claimed in claim 1 wherein said separating means comprises a separating bar mounted on the upper surface of said upper lid, said separating bar having a length that is substantially equal to the inside diameter of said flange means and said generating bar has a height that is substantially equal to the height of said flange means.

6. A device as claimed in claim 1, said device further including a rubber plug seat that seals said pump housing with the crystal ball and the ornament base support, said plug seat being concave inwardly.

7. A device as claimed in claim 1 wherein said pump housing has in plan view essentially a racetrack configuration, and wherein said upper lid and separating means have a central bore therethrough for receiving a driving shaft, and wherein said liquid inlet and said liquid outlet are located at opposite ends of said pump housing.

8. A device as claimed in claim 1 wherein said base is substantially a disk that is circular in plan view; wherein said flange means is comprised of a peripheral flange dependingly mounted to said base; and wherein said base is further comprised of a shaft which is mounted to said base and which extends through said pump housing and is operatively connected to said rotating means.

9. A device as claimed in claim 8 wherein said openings in said flange means are in the bottom periphery of said flange and are equally angularly spaced around said flange bottom periphery.

10. A device as claimed in claim 1 wherein said rotating means comprises a motor; and device further comprises a motor casing that encompasses said motor, said casing being mounted to the bottom of said pump housing, said motor including a motor shaft which extend through said liquid seal at one end of said motor and which shaft extends through said casing at the other end thereof.

11. A device for spraying water contained in a crystal ball ornament that also includes a base support, a crystal ball mounted on the base support, a decoration item mounted inside the crystal ball, the spraying device comprising:

a pump housing having an interior cavity and mounted to the underside of the base, said pump housing including an upper lid that seals the cavity and has spaced apart water inlet and water outlet openings therethrough, an orifice in the bottom of said housing, a resilient liquid seal mounted in said orifice;

an impeller mounting means located in one of said water openings, said mounting means comprising a collar chute having a central opening;

a protruding member depending from the bottom of said upper lid and located adjacent said collar chute;

an impeller mountable at one end thereof in said mounting means, said impeller including an axial having an upper member configured so as to be able to be received by said collar chute, and said impeller axle has an axial length such that during assembly of said device, said upper member can be positioned against said protruding member, and the lower end of said impeller axle will extend through and will be sealed by said liquid seal; and means for rotating said impeller, said means comprising a shaft detachably connected to said impeller, and a motor for driving said shaft.

12. A device as claimed in claim 11, wherein said impeller upper member has a substantially conical shape and said collar chute has a circular opening extending through said upper lid and has a conical bearing surface for receiving said impeller upper member; and wherein said protruding member comprises a depending annular ring that circumscribes the opening of said collar chute.

* * * * *